US006082633A

United States Patent [19]

Kephart et al.

[11] Patent Number: 6,082,633

[45] Date of Patent: Jul. 4, 2000

[54] INTERACTIVE TOY SPRINKLER

[75] Inventors: Richard C. Kephart, Northfield; Peter C. McEachen, Cleveland Heights; Thomas P. Sullivan, Akron, all of Ohio

[73] Assignee: The Little Tikes Company, Hudson, Ohio

[21] Appl. No.: 09/231,930

[22] Filed: Jan. 14, 1999

[51] Int. Cl.[7] ..... B05B 1/12; B05B 1/14

[52] U.S. Cl. ..... 239/211; 239/247; 239/279; 239/280; 239/536; 239/580

[58] Field of Search ..... 239/211, 229, 239/246, 247, 251, 273, 279, 280, 280.5, 281, 587.1, 588, 536; D23/213, 214

[56] References Cited

U.S. PATENT DOCUMENTS

| | | | |
|---|---|---|---|
| D. 118,263 | 12/1939 | Kent et al. . | |
| D. 226,193 | 1/1973 | Anderson | D23/7 |
| D. 259,887 | 7/1981 | Croushore | D21/59 |
| D. 263,868 | 4/1982 | Chow et al. | D23/7 |
| D. 326,502 | 5/1992 | Arnold, Jr. | D23/221 |
| D. 374,914 | 10/1996 | Wang | D23/214 |
| D. 399,915 | 10/1998 | McEachen | D23/214 |
| 913,791 | 3/1909 | Well . | |
| 1,796,942 | 3/1931 | Pottenger, Jr. . | |
| 1,831,540 | 11/1931 | Nelson . | |
| 1,938,838 | 12/1933 | Jacobson . | |
| 1,962,308 | 6/1934 | Jacobson . | |
| 2,475,537 | 7/1949 | Ashworth . | |
| 2,601,559 | 6/1952 | Riblet . | |
| 2,967,024 | 1/1961 | Aubert | 239/261 |
| 2,968,440 | 1/1961 | Cone | 239/203 |
| 3,452,930 | 7/1969 | Karbo | 239/70 |
| 3,458,136 | 7/1969 | Belaieff | 239/227 |
| 3,552,655 | 1/1971 | Feeney | 239/587.1 X |
| 3,878,990 | 4/1975 | Geraudi | 239/236 |
| 5,704,549 | 1/1998 | Kephart et al. | 239/236 |
| 5,836,522 | 11/1998 | Przystawik | 239/588 |

*Primary Examiner*—Lesley D. Morris
*Attorney, Agent, or Firm*—Foley & Lardner

[57] ABSTRACT

A toy sprinkler (10) is disclosed comprising a hub assembly (12) having a water pressure activated spinning cap member (68) and a manifold member (64) connected to a pressurized water source. Multiple right angle arm assemblies (14, 16, and 18) are connected to the manifold (64) and direct water by a conduit (34) to wand members (22) mounted to remote ends of arm assemblies (14–16). The conduit (34) affords sufficient slack to allow removal of the wand members (22) from the arm assemblies (14–16) and the aiming of water ejected from the wand members (22).

20 Claims, 11 Drawing Sheets

INTERACTIVE TOY SPRINKLER

BACKGROUND OF THE INVENTION

1. Field of the Invention

The present invention relates to toy sprinklers in general and, more specifically, to toy sprinklers having interactive play elements.

2. The Prior Art

Toy sprinklers are well known in the toy industry. For example, U.S. Pat. No. 5,704,549 teaches an oscillating sprinkler in which multiple sprinkler arms ride up and down over a track surface and dispense water in an oscillating pattern. The center, or hub, of the sprinkler is rotationally mounted and water pressure driven in a circular path to dispense a secondary pattern of water spray complementary to the spray dispelled by the arms.

While the above sprinkler works well and has established substantial commercial appeal, several deficiencies exist which make the sprinkler less than an ideal solution to the market's needs. First, the spray pattern produced by the sprinkler is predictable and repeating. It therefore lacks the interest appeal that a variable spray pattern affords. Secondly, the sprinkler neither interacts with the user to a high degree nor affords alternative modes of play. Thirdly, the sprinkler, because of the convoluted track, has a substantial depth dimension, making the sprinkler relatively cumbersome to store.

Accordingly, there remains a need for a sprinkler providing for greater versatility and play value. Such a sprinkler must interact with the user and provide enhanced play variability in a safe and controlled environment. Further, such a sprinkler ideally would offer a user a range of play options and, thereby, enhance play value and retain the interest of the user. Lastly, the sprinkler should be compact for easy and space efficient storage.

SUMMARY OF THE INVENTION

An interactive toy sprinkler is disclosed comprising a hub housing having a water inlet portal and a water distribution manifold. A plurality of L-shaped nozzle housings are spaced apart and extend from the hub housing, each nozzle housing supporting a removable wand at a remote end in a substantially vertical orientation. Flexible conduits are connected to distribute water received by the hub housing to the wands at the remote ends of the nozzle housings. The wands have outlet apertures of varying patterns from which the water is ejected under pressure. The conduits are of sufficient length to allow for removal of the wands a distance from the nozzle housings for hand held play by the user. When the nozzles are returned into engagement with upper ends of the nozzle housings, the respective conduits retract back into their respective nozzle housings for storage.

The nozzle housings are provided with a flexible joint whereby the wands may be deflected temporarily out of their vertical orientation by a user, thus varying the direction and pattern of the water spray. The play value of the sprinkler is, accordingly, enhanced by the multitude of orientations which the user can impart to the wands, varying the spray pattern and its direction.

A central hub is provided which rotates under water pressure and dispenses a secondary spray pattern therefrom which, in combination with the variable attitudes which the nozzle housings and wands are free to assume, achieves a sprinkler of heightened interest and appeal.

The nozzle housings collapse from a freestanding position while in use into a coplanar and flat orientation for storage, thereby minimizing the storage space required.

Accordingly, it is an objective to provide a sprinkler having multiple spray portals which create an interesting spray pattern to the user.

A further objective is to provide a sprinkler having high interaction with multiple users.

Still a further objective is to provide a sprinkler wherein the arm assemblies will deflect for safety.

Yet a further objective is to provide a sprinkler having multiple discharge portals interconnected to a single input source.

An additional objective is to provide a sprinkler which collapses for easy storage.

Another objective is to provide a sprinkler which consists of a relatively few component parts which are economically manufactured and readily assembled.

These and other objectives, which will be apparent to those skilled in the art, are achieved by a preferred embodiment which is described in detail below and illustrated in the accompanying drawings.

DESCRIPTION OF THE ACCOMPANYING DRAWINGS

Figure 14:
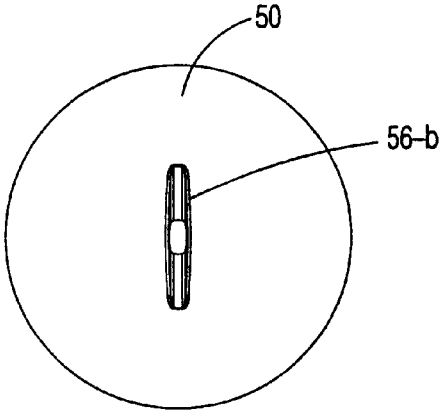
Figure 15:
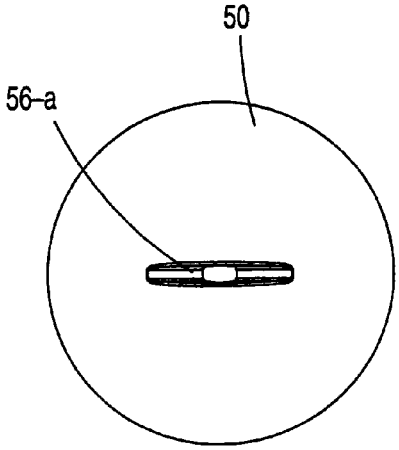
Figure 16:
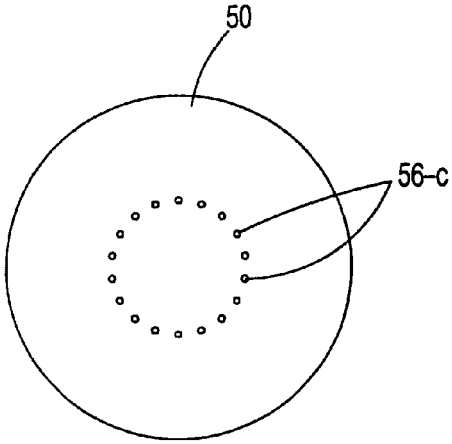

FIGS. 14 through 16 inclusive are plan views of the exit portal patterns of the three sprayer wand members.

DESCRIPTION OF THE PREFERRED EMBODIMENT

Figure 1:
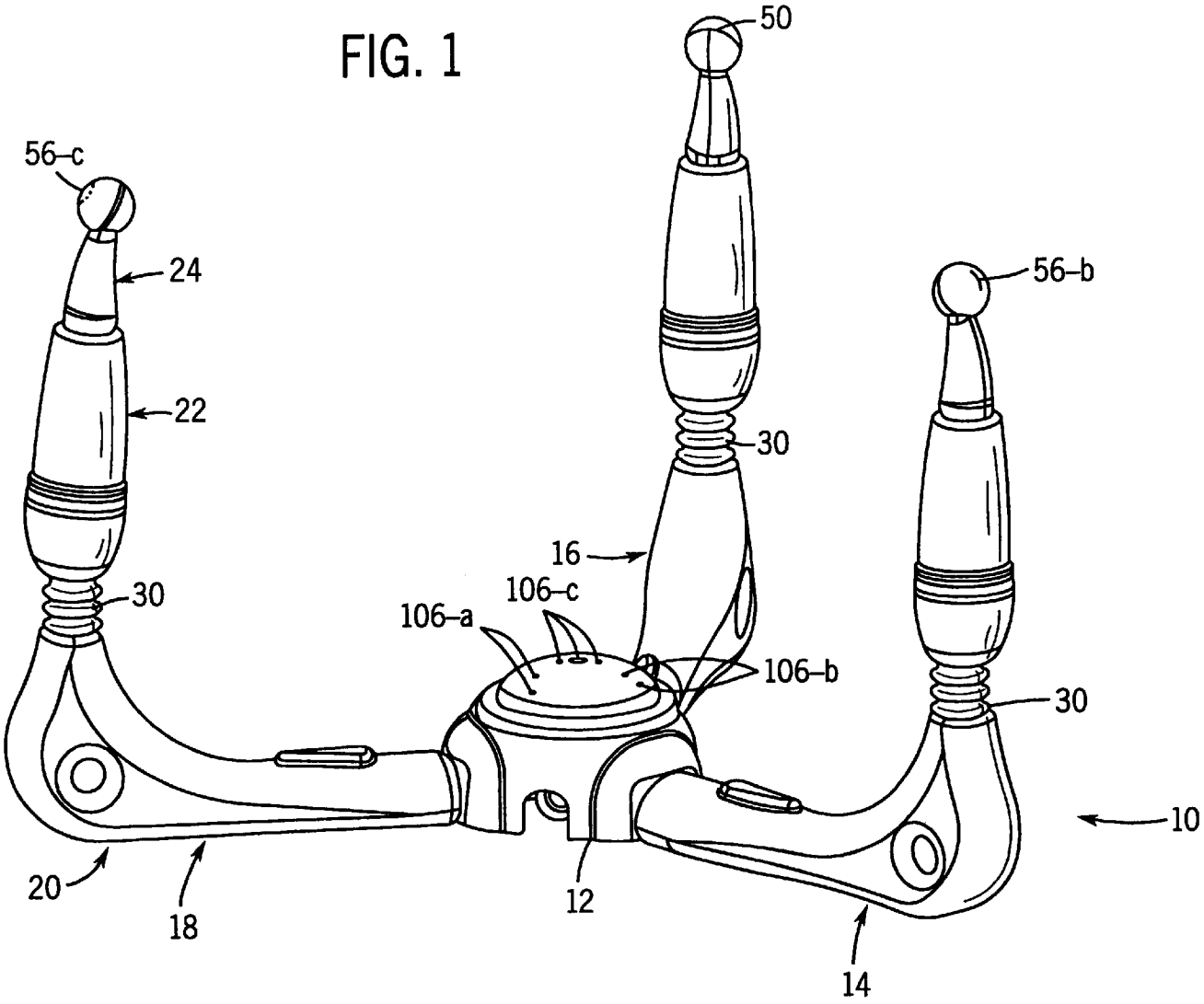
FIG. 1 is an assembled perspective view of the subject sprinkler.
Figure 2:
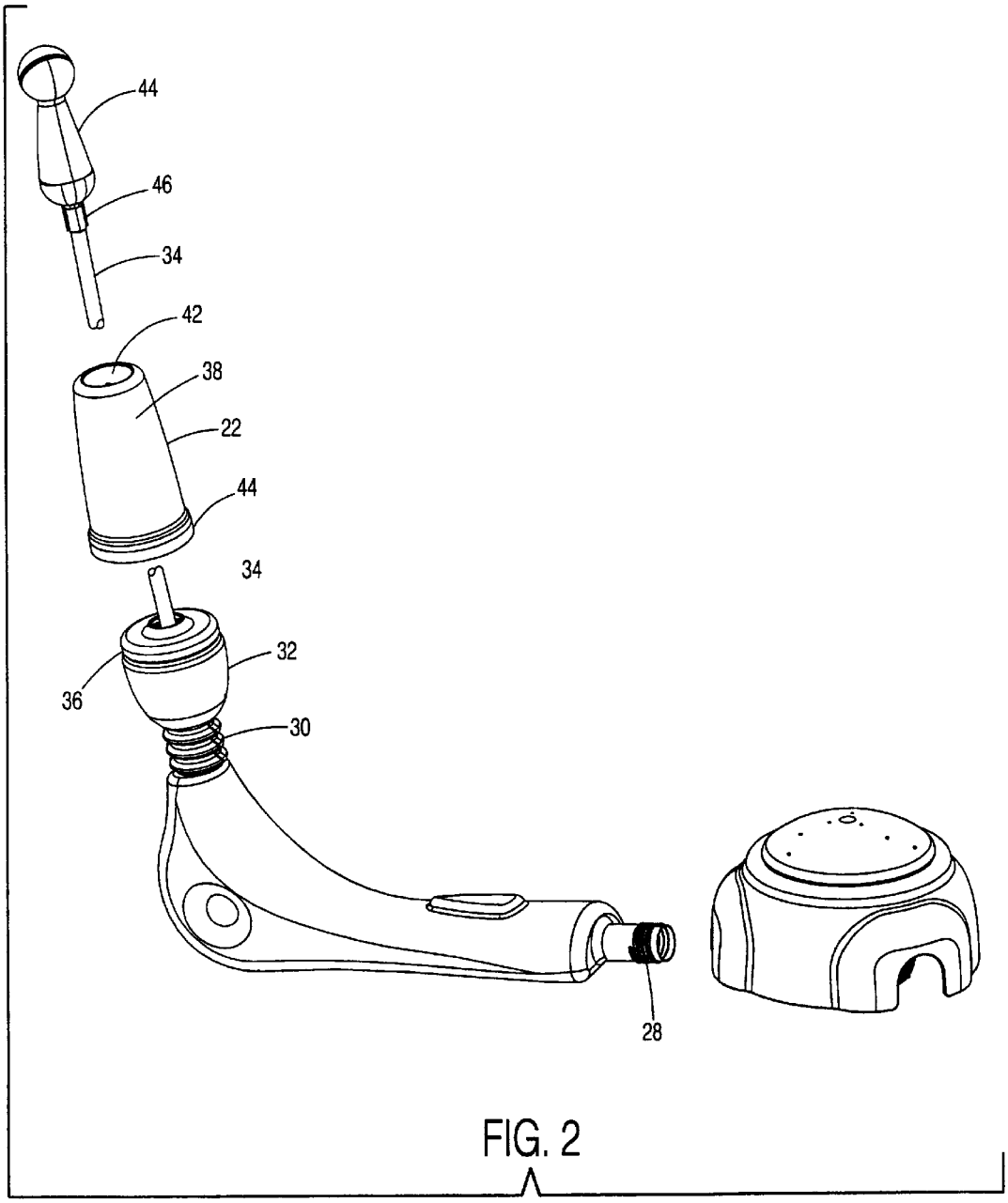
FIG. 2 is an exploded perspective view of one nozzle arm assembly and the central hub assembly.
Figure 3:
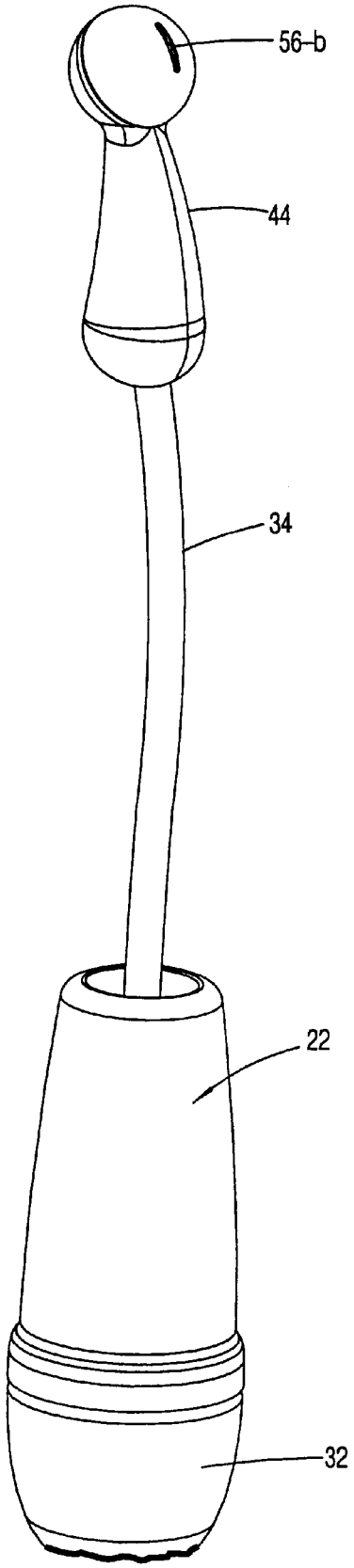
FIG. 3 is a perspective view of a sprayer wand and nozzle housing with the sprayer wand in the extended position.
Figure 4:
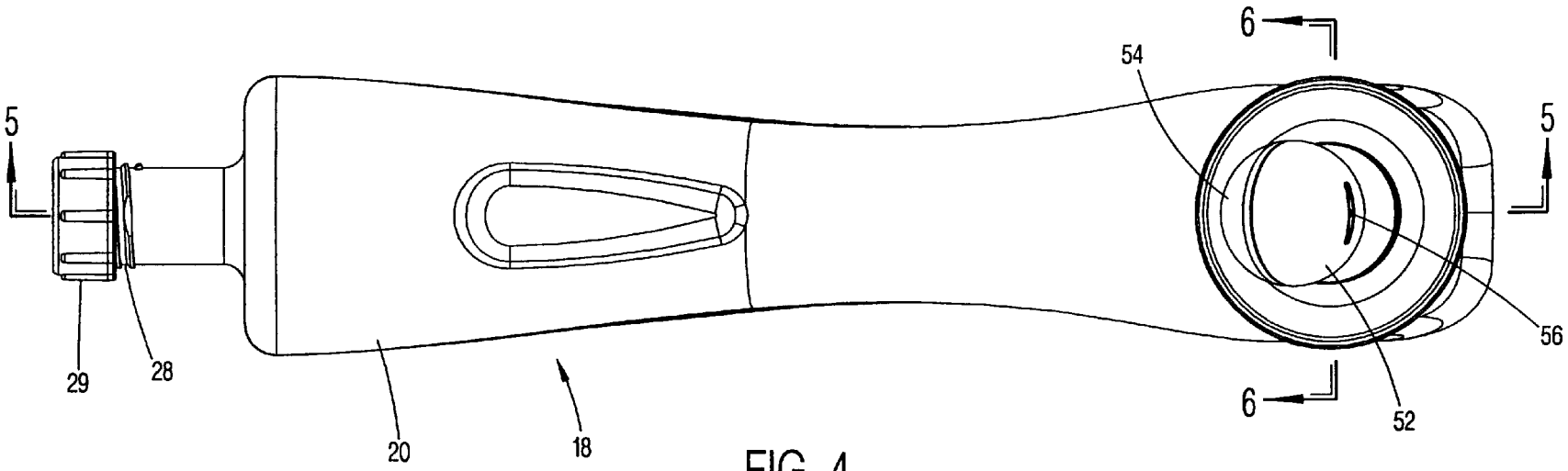
FIG. 4 is a top plan view of a nozzle arm assembly.

Referring initially to FIGS. 1, 2 and 3, the subject toy sprinkler 10 is shown to comprise generally a hub assembly 12, and three nozzle arm assemblies 14, 16 and 18. Each arm assembly 14, 16, and 18 comprises an L-shaped arm housing 20; a wand support sleeve 22; and a sprayer wand 24. The components 20, 22 and 24 are each formed preferably of plastic material such as polyethylene by conventional processes such as injection and blow molding. However, other suitable materials formed by alternative means may be optionally substituted.

As seen in FIGS. 2, 4, 5 and 6, the L-shaped arm housing 20 is formed having a hollow core 26, extending from a lower threaded end 28 to an upper end of housing 20. The Joint 30 is integrally formed with an upward vertical portion of the housing 20.

An upper bowl shaped portion 32 of housing 20 is connected to a portion of housing 20. The bowl portion 32 is hollow and a flexible conduit, preferably a plastic tube, 34 is routed through the housing 20 from the threaded end 28. An annular instepped shoulder 36 is provided at the upper rim of portion 32. The wand support 22 is substantially shaped as an inverted cup and includes frustroconical sidewalls 40 defaming an internal axial passageway 41. A semispherical seat depression 42 is disposed within an upper end, and a hollow cylindrical receptacle 43 depends from a bottom of depression 42 into the interior of support 22.

Figure 5:
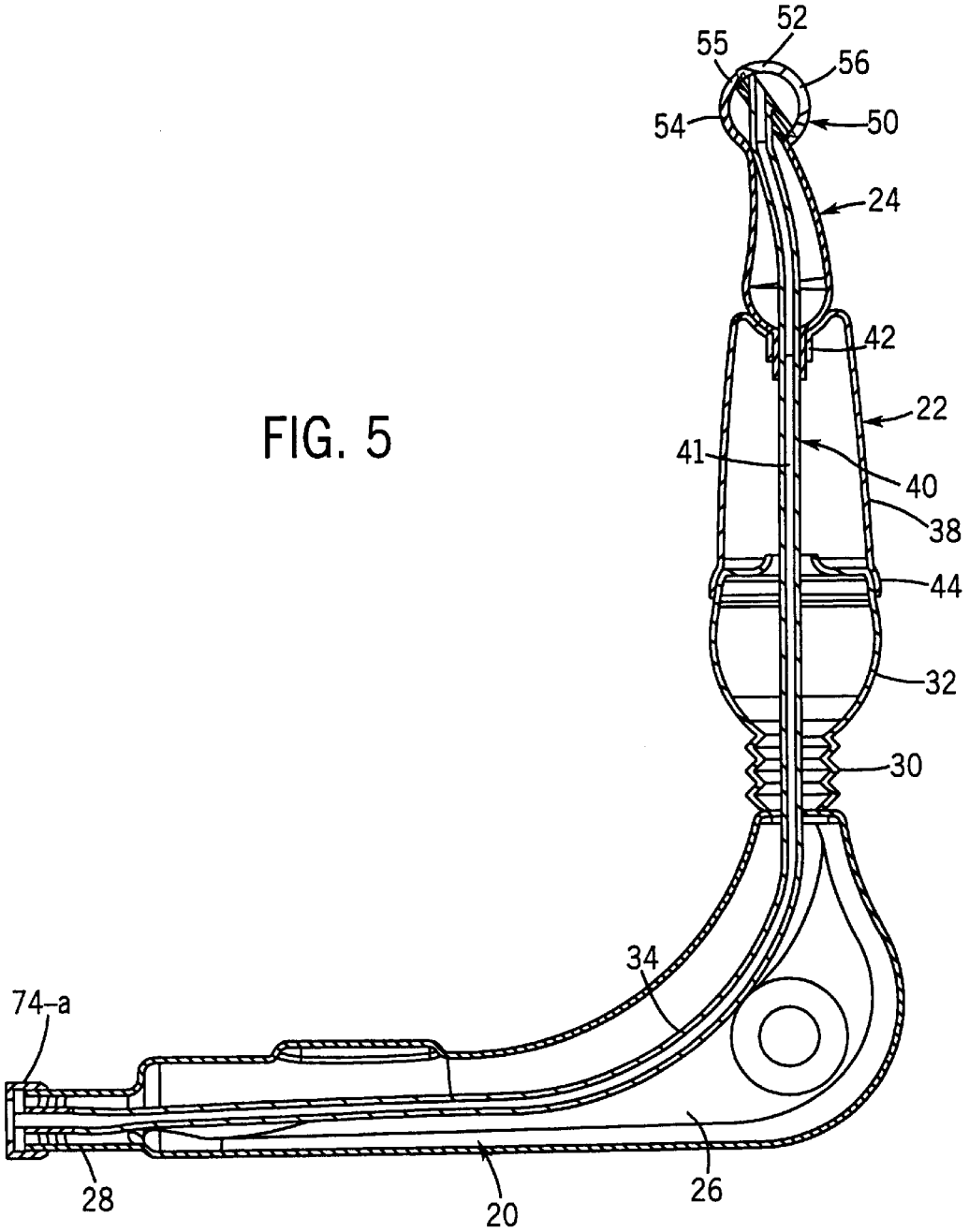
FIG. 5 is a longitudinal section view of one nozzle arm assembly taken along the line 5—5 of FIG. 4.
Figure 8:
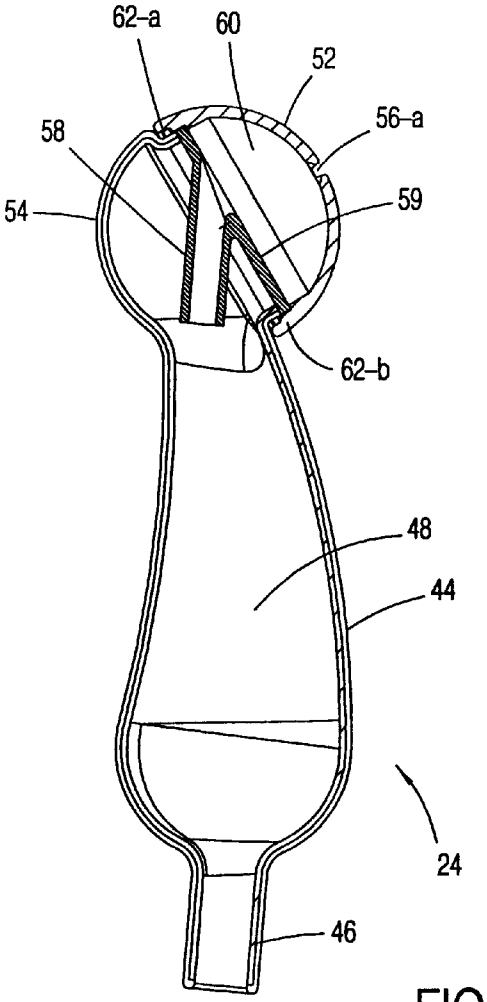
FIG. 8 is a longitudinal section view of the sprayer wand in FIG. 7, taken along the line 8—8.
Figure 7:
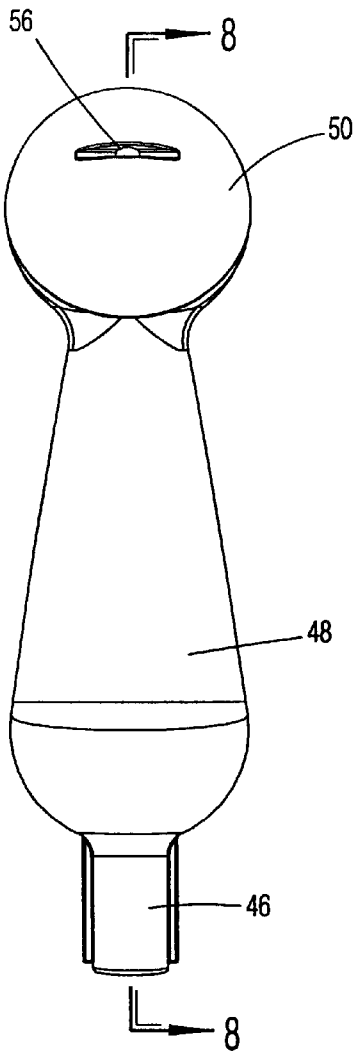
FIG. 7 is a side elevational view of a sprayer wand.

With reference next to FIGS. 7 and 8, each nozzle arm assembly 14 receivably supports one sprayer wand 24, having a frustroconical body 44 from which a hollow stem member 46 depends. A central axial passageway 48 extends from one end of wand 24 to the opposite end. Mounted to the top end of wand 24 is a spherical spray head 50 comprising opposed semi-spherical head components 52, 54. The components of the wand 24 are likewise formed of conventional plastic by conventional plastic processing methods. The flexible conduit 34 extends through and in interference fit with the stem portion 42 of the body 44 and thence an upper portion of conduit 24 extends from the stem portion 42 into the upper spherical head 50 as shown. The stem portion 42 grasps the conduit 34 extending therethrough and conduit 24 can be manipulated through manual manipulation of wand 24. The upper portion of conduit 24 is secured to a sleeve 55 formed in a lower wall of head-component 52. The lower stem portion 42 is sized for close receipt within the receptacle 43 of the seat 42 of support 22. So positioned, the wand 24 is vertically supported atop the support 22 and the conduit 34 is encased within the passageway extending between the threaded end 28 and the spherical wand head 50 as shown in FIG. 5.

The three wands 24 comprising the sprinkler 10 each are adapted to provide a unique spray pattern. Respective spray patterns are achieved by the configuration of orifices 56-A, 56-B and 56-C as shown in FIGS. 14 through 16 inclusive. The orientation of slits 56-A and 56-B provide a wider spray pattern, one substantially horizontal and the other vertical. Orifices 56-C are in a circular pattern and produce a circular stream of water therefrom.

The internal configuration of each spray head 50 is shown in FIGS. 7 and 8. A dependent stem 58 extends from a wall 59 covering the lower side of semi-spherical component 52. A fluid reservoir 60 is defined between the wall 59 and the outer curved walls of the component 52. The stem 58 is sized to accommodate frictional fit of the upper end of the conduit 34 thereover, whereupon the fluid from conduit 34 under pressure fills the reservoir 60 and is ejected through the orifices 56-A, 56-B and 56-C. The semi-spherical components 52, 54 are formed to overlap as shown at 62-A and 62-B and are sealed together by adhesive to form a water tight joint.

Figure 10:
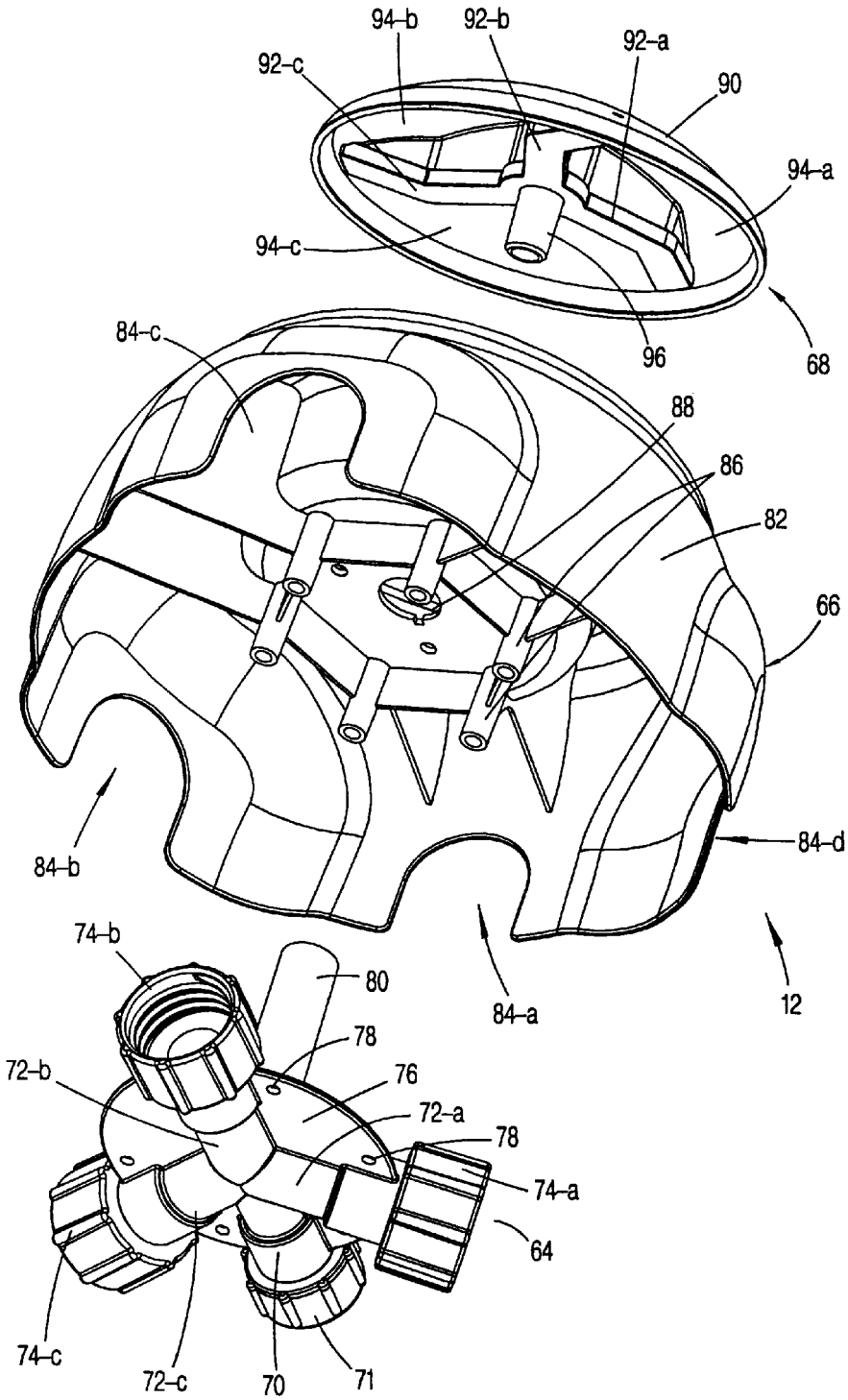
FIG. 10 is an exploded perspective view of the hub assembly.
Figure 11:
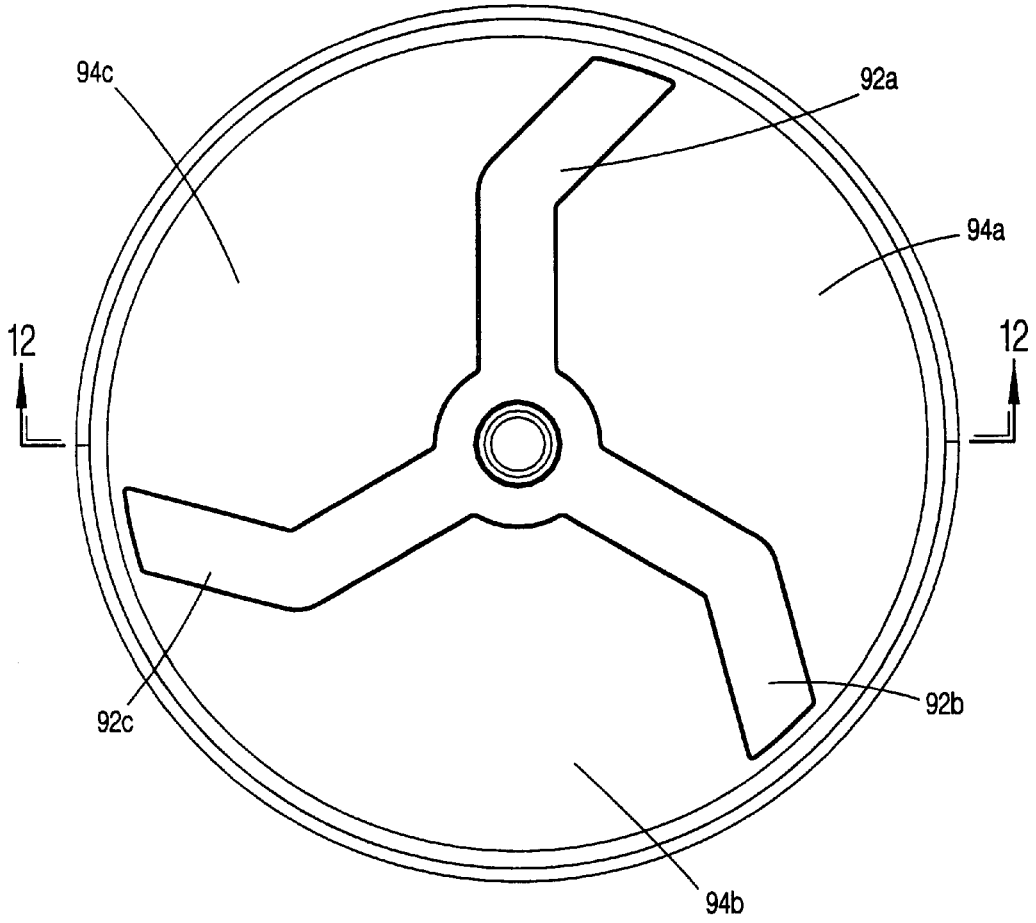
FIG. 11 is a bottom plan view of the cap assembly.
Figure 12:
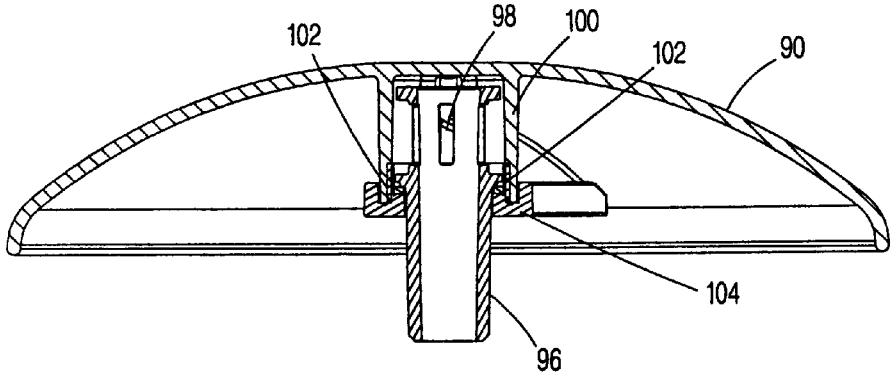
FIG. 12 is a transverse section view through the cap assembly shown in FIG. 11, taken along the line 12—12.
Figure 13:
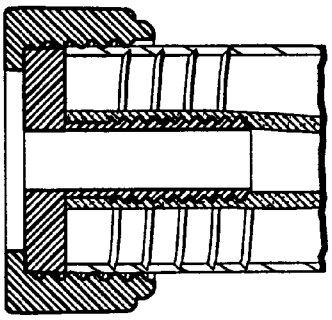
FIG. 13 is a section view through coupled nozzle housing and the hub assembly manifold.

Referring to FIGS. 10, 11 and 12, the center hub assembly 12 is shown to comprise a plastic manifold 64, a base housing 66, and a cap member 68. The manifold 64 includes an intake conduit 70 having a screw threaded coupling collar 71. The intake conduit 70 communicates with three spaced apart outlet conduits 72-A, 72-B and 72-C, each of which having a respective screw threaded coupling collar 74-A, 74-B and 74-C. A circular central plate 76 is formed to connect and hold in fixed relationship the conduits 70 and 72-A–C. A plurality of peripherally located through apertures 78 extend through the plate 76 as shown in FIG. 10. A cylindrical stem 80 is formed to project upward from the center of plate 76 as indicated.

The housing 66 is formed as having a shell shape, including a downturned peripheral skirt 82. Substantially semi-circular cutouts 84-A, 84-B, 84-C and 84-D are formed into a lower edge of skirt 82 at locations corresponding with conduits 70, and 72-A–C. A plurality of support posts 86, equal in number and aligning with manifold apertures 78, depend downward from an underside of base housing 66 as shown. A center bore 88 extends through the housing 66 on a center axis.

The cap member 68 is downwardly concave, having a domed top surface 90 and three partition walls 92-A, 92-B and 92-C extending outward from the center along an underside surface of member 68. The walls 92 are angled and extend to a downward rim of member. The walls serve to segment the concave underside of member 68 into three chambers 94-A, 94-B and 94-C. A cylindrical stem 96 depends downward from the member 68 on a center axis. As seen best from FIG. 12, the underside of the member 68 includes a cylindrical post 100 having three portals 98 formed to extend into the post 100, each portal 98 positioned to correspond with a respective one of the chambers 94 A–C. A retainer 104 extends around the stem 96 and clamps to a lower end of the post 100 and supports the post 100 thereon. So supported, the cap member 68 is free to rotate about stem 96 supported by retainer 104.

As best seen from FIGS. 1 and 11, three spiral fingers of apertures 106-A, 106-B and 106-C are formed to extend through the cap member 68, each finger of apertures correspondingly located to communicate with a respective one of the chambers 94 A–C.

The assembly of the subject sprinkler proceeds as follows. Referring to FIG. 10, the manifold 64 is received up and into the base housing 66 as support posts 86 align with respective apertures 78. Assembly screws (not shown) are inserted from the bottom through apertures 78 and into posts 86 to secure the components together. Stem 80 projects upward through center aperture 88 and the conduits 70 and 72 A–C align axially with a respective one of the cut outs 84 A–D.

The cap is assembled to the top of stem 96 as post 100 of the cap member 68 is pivotally registered upon retainer 104. The lower end of stem 96 is inserted in close fit into the upper end of stem 80 of the manifold. So assembled the cap 68 may freely pivot atop the housing 66 about a center line extending downward therethrough.

Figure 6:
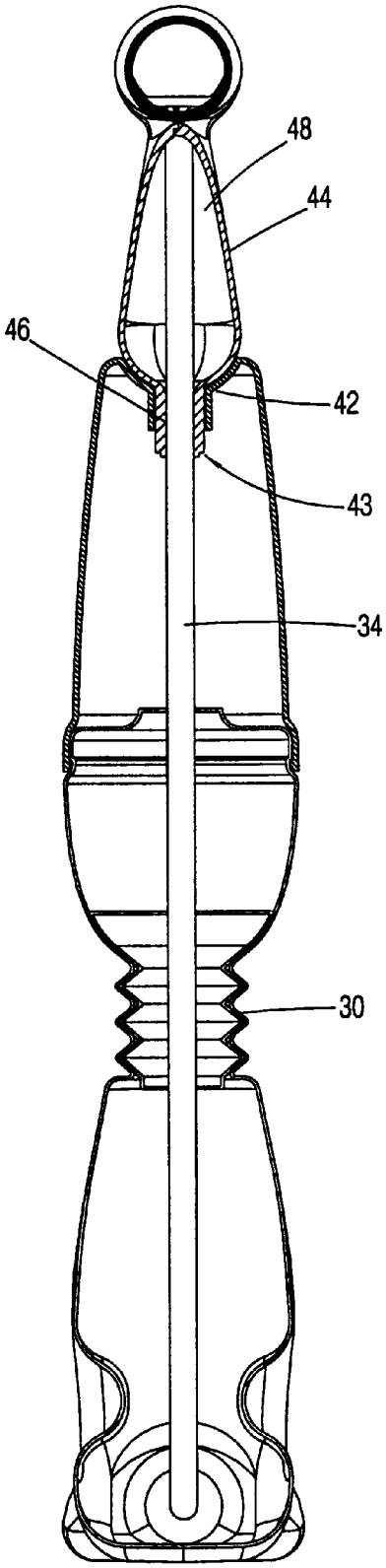
FIG. 6 is a transverse section view of one nozzle arm assembly taken along the line 6—6 of FIG. 4.

The arm assemblies assemble together by snapping the wand support 22 over the socket 32 so that the axial passageways therethrough align. The wand 24 assembles to support 22 by the close insertion of stem 46 through aperture 43 and seating of the radiussed lower end of the wand 24 into socket 42 (FIGS. 2 and 6). The conduit 34 routes from the lower end of the assembly through the nozzle arm housing 20, the socket 32, the support 22, and thence through the wand 22 and into the upper spray head 50. The upper end of the conduit 34 is sized to attach frictionally over the head stem 55.

The threaded end 28 of each arm assembly 14, 16, and 18 attaches to a respective one of the manifold conduits 72 A–C via threaded coupling collars 74 A–C. The lower ends of the arm assemblies extend through a respective cutout 84 A–C. In the use position represented by FIG. 1, the coupling between the arm assemblies and the manifold conduits maintain the arm assemblies in an upright condition. Also, a protrusion (not shown) on arm 20 mates with slot (not shown) in 84 B–D. The arm housing 20 is formed at a right angle so as to support the wand support 22 and the wand 24 in a vertical orientation. It will be appreciated that the wand apertures 56 A–C are oriented normally away from the hub assembly 12.

In addition to providing a safety attribute to the sprinkler, deflection of the wand when in use adds play value to the sprinkler and maintains a high level of entertainment and interest. While an integral bellows type spring is preferred, it will be appreciated that other spring components, known to those skilled in the art, may be employed. By way of example with no limitation intended, a metallic compression spring instead of the bellows spring may be attached to the vertical arm housing segment to provide the requisite resiliency.

The housing 66 rests upon ground surface. The intake conduit 70 couples to a standard garden hose via coupling 71 and receives pressurized water therefrom. Manifold 64 divides the intake stream of water between conduits 72 A–C and stem 80. Stem 80 directs pressurized water upward and into the three cap chambers 94 A–C which is then expelled through spiral apertures 106 A–C. The exit of pressurized water from apertures 106 A–C and the angular orientation of the spiral arms 106 acts to cause the cap 68 to spin atop the housing 66. The spinning action adds variation to the stream of water exiting cap 68 and enhances play value and interest. Such a spinning cap is taught by U.S. Pat. No. 5,704,549, incorporated herein by reference.

It will further be appreciated from FIGS. 3 and 5 that the conduit 34 is sufficiently long to allow the wand 24 to be removed from the seat 42 when in use by a distance of approximately eight inches. This affords the user an additional mode of play and allows the stream of water ejected from the wand 24 to be directed and aimed three hundred and sixty degrees. The wand, when returned to the seat 42, continues its ejection of water until the water source is closed at its source. The arm housing 20 and wand support 22 axially passageways are sufficiently large, and the conduit 34 is sufficiently flexible, to allow the slack of conduit 34 to be retracted into housings 20 and 22 when the wand 24 is seated upon seat 42. Thus, with the wand in the seated position, no portion of the conduit 34 resides outside of the housings 20 and 22.

Figure 9:
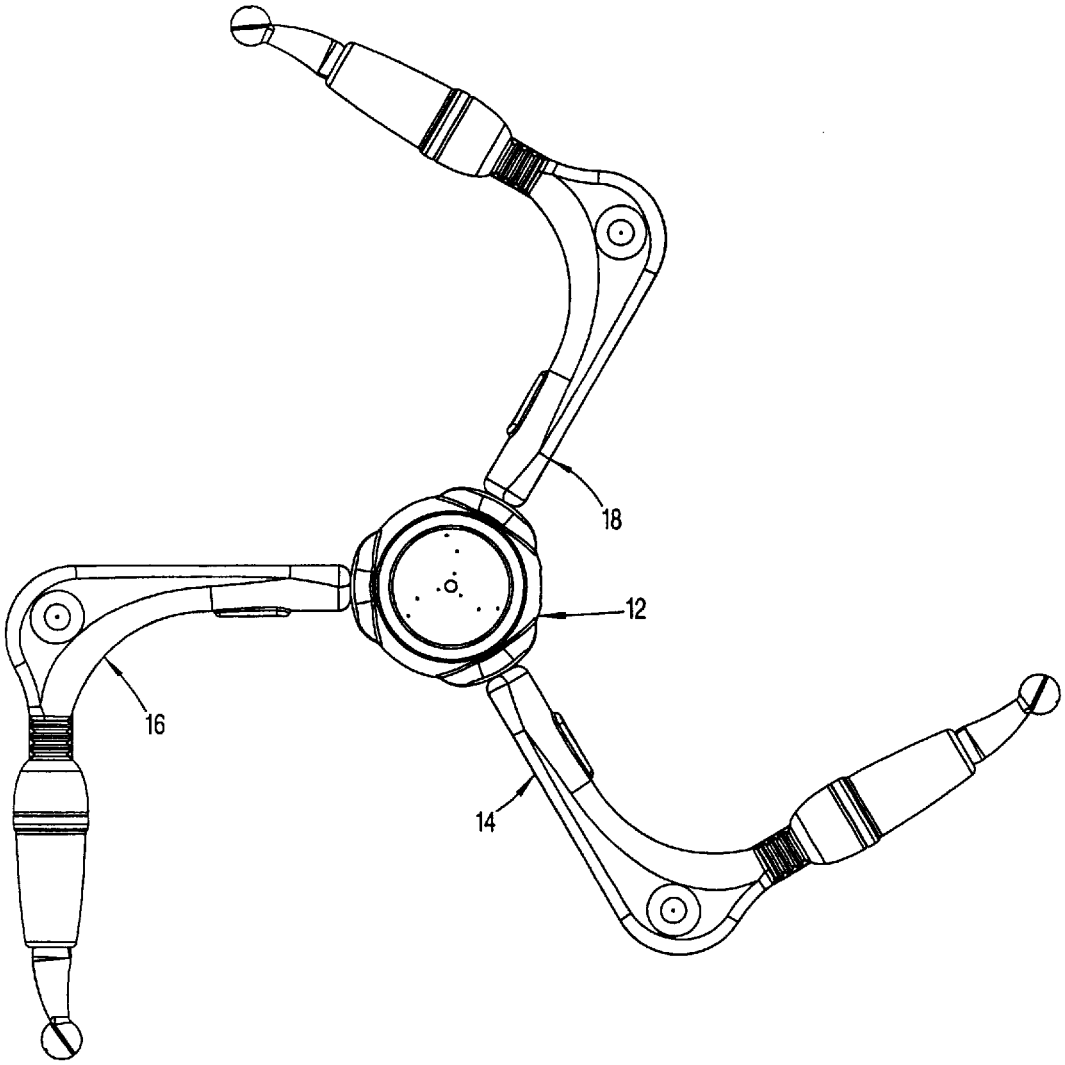
FIG. 9 is a top plan view of the sprinkler in the collapsed condition.

When the sprinkler is to be stored, the arm assemblies 14, 16 and 18 may be repositioned into a coplanar relationship with the hub assembly 12 as will be appreciated from FIGS. 9 and 10. The couplings 74 A–C are loosened to allow rotation of the arm assemblies 14, 16, and 18 from the upright orientation depicted in FIG. 1 into the flat, or co-planar orientation shown in FIG. 9. The sprinkler may subsequently be suspended from a wall or the like, whereby utilizing a minimum amount of storage space.

While the above describes the preferred embodiment of the subject invention, the invention is not intended to be so limited. Other embodiments, which will be apparent to those skilled in the art and which utilize the teachings herein set forth, are intended to be within the scope and spirit of the subject invention.

What is claimed is:

1. A sprinkler nozzle comprising:

a nozzle housing having a fluid intake portal;

a wand detachably connected to the nozzle housing and having at least one discharge portal extending therein, the nozzle housing supporting the wand in a predetermined orientation;

an internal fluid passageway extending within the nozzle housing and nozzle discharge portion and connecting the intake and discharge portals together;

the nozzle housing having a joint for lateral movement of the wand relative to the nozzle housing in and out of said predetermined orientation; and biasing means for returning the wand to the predetermined orientation relative to the nozzle housing.

2. A sprinkler nozzle according to claim 1, wherein the biasing means comprises a flexible portion of the nozzle housing.

3. A sprinkler nozzle according to claim 1, wherein the internal fluid passageway comprises a fluid conduit.

4. A sprinkler nozzle according to claim 3, wherein the fluid conduit moves between a retracted position within the nozzle housing and an extended position in which at least a portion of the fluid conduit extends from the nozzle housing.

5. A sprinkler nozzle according to claim 4, wherein the portion of the fluid conduit which extends from the nozzle housing in the extended position is connected at a remote end to the wand.

6. A sprinkler comprising:

a hub housing having an intake portal;

a plurality of nozzle housing connected to and extending from the hub housing;

a plurality of wands, each wand detachably connected to a respective nozzle housing and having at least one discharge portal extending therein, each of the plurality of nozzle housings supporting a respective wand in a predetermined orientation; an internal fluid passageway connected between the hub housing intake portal and each wand discharge portal.

7. A sprinkler according to claim 6, wherein the hub housing comprises:

a base;

a cap portion rotatably mounted to the base;

a cap intake portal connected to the cap portion;

a cap discharge portal extending through the cap portion.

8. A sprinkler according to claim 7, wherein the hub housing further comprises a manifold connected to the hub housing intake portal and distributing fluid therefrom to the cap intake portal and the plurality of nozzle housings.

9. A sprinkler according to claim 6, wherein each said nozzle housing has a joint for lateral movement of its respective wand in and out of said predetermined orientation.

10. A sprinkler according to claim 9, further comprising biasing means for returning each said wand to the predetermined orientation relative to its respective nozzle housing.

11. A sprinkler according to claim 10, wherein the biasing means comprises a flexible portion of each nozzle housing.

12. A sprinkler according to claim 6, wherein the internal fluid passageway comprises a plurality of fluid conduits, each conduit connected at a remote end to a respective one of said wands.

13. A sprinkler according to claim 12, wherein each fluid conduit moves between a retracted position within its respective nozzle housing and an extended position in which at least a portion of the fluid conduit extends from the respective nozzle housing.

14. A sprinkler comprising:

a hub housing having an intake portal;

a plurality of L-shaped nozzle housings connected to and extending from the hub housing;

a plurality of wands, each detachably connected to a respective nozzle housing and having at least one discharge portal extending therein, each wand being supported at a remote end of its respective nozzle housing in a substantially vertical orientation; and each L-shaped nozzle housing having an internal fluid passageway connected between the hub housing intake portal and each wand discharge portal.

15. A sprinkler according to claim 14, wherein each said nozzle housing has a joint for lateral movement of its respective wand in and out of said substantially vertical orientation.

16. A sprinkler according to claim 15, further comprising biasing means for returning each said wand to said substantially vertical orientation.

17. A sprinkler according to claim 16, wherein the biasing means comprises a flexible portion of each nozzle housing.

18. A sprinkler according to claim 14, wherein each internal fluid passageway comprises a fluid conduit, each conduit connected at a remote end to a respective one of said wands.

19. A sprinkler according to claim 18, wherein each fluid conduit moves between a retracted position within its respective nozzle housing and an extended position in which at least a portion of the fluid conduit extends from the respective nozzle housing.

20. A sprinkler according to claim 14, wherein each said nozzle housing moves between an upright position placing the wand supported thereby in said vertical orientation and a flat storage position in which the nozzle housings are in a substantially co-planar orientation with said hub housing.

* * * * *